US007065917B2

(12) United States Patent
Lahti

(10) Patent No.: US 7,065,917 B2
(45) Date of Patent: Jun. 27, 2006

(54) RIFLE BORE PERISCOPE

(76) Inventor: Arne W. Lahti, 68565 Range Line Rd., Iron River, MN (US) 54847

( * ) Notice: Subject to any disclaimer, the term of this patent is extended or adjusted under 35 U.S.C. 154(b) by 96 days.

(21) Appl. No.: 10/872,658

(22) Filed: Jun. 21, 2004

(65) Prior Publication Data

US 2006/0010755 A1 Jan. 19, 2006

(51) Int. Cl.
*F41G 1/00* (2006.01)

(52) U.S. Cl. ..... 42/134; 42/111; 42/116; 42/118

(58) Field of Classification Search ..... 42/111, 42/113, 116, 118, 134; 359/402, 403, 404, 359/405, 406
See application file for complete search history.

(56) References Cited

U.S. PATENT DOCUMENTS

| | | | | |
|---|---|---|---|---|
| 3,074,172 | A * | 1/1963 | Cooper | 33/228 |
| 3,112,567 | A * | 12/1963 | Flanagan | 42/121 |
| 3,228,108 | A * | 1/1966 | Chaperon | 42/134 |
| 4,750,269 | A * | 6/1988 | Townsend et al. | 42/121 |
| D357,490 | S * | 4/1995 | Browning | D16/132 |
| 6,604,316 | B1 * | 8/2003 | Custer | 42/118 |

* cited by examiner

*Primary Examiner*—Michael Carone
*Assistant Examiner*—Stewart Knox
(74) *Attorney, Agent, or Firm*—Nikolai & Mersereau, P.A.; Thomas J. Nikolai

(57) ABSTRACT

A periscope device specifically adapted to fit in the breach of a firearm. Using a housing equipped with at least a pair of mirrors in parallel relation to one another, a user can look down the barrel of his or her firearm. This is especially useful for checking the barrel for obstructions and for initially bore sighting the firearm when conducting gun sight alignment.

7 Claims, 5 Drawing Sheets

RIFLE BORE PERISCOPE

BACKGROUND OF THE INVENTION

I. Field of the Invention

This invention relates generally to periscope devices, and more particularly to periscope devices which enable a person to look down the bore of a rifle even when such a view is out of the user's direct line of sight.

II. Discussion of the Prior Art

Several methods for sighting a rifle are well known in the art. One of these, called bore sighting, generally requires a user to look down the rifle's barrel to align the barrel with a target bull's eye and then adjust the sight so it is also on the bull's eye. This step is needed to ensure a subsequent test shot generally lands somewhere on the paper on which the target is printed. Next, the sight is zeroed. The rifle is placed in a stationary mount, loaded, and a test shot is fired. Next, while the rifle is still being held in place, its sighting scope is further adjusted to place the cross-hairs on the location where the first shot hit the target. Difficulty arises during the bore-sighting phase when sighting certain rifles, automatic weapons and other firearms which do not permit a user to easily look down the bore of the gun.

Additionally, hard to see obstructions in the barrel of the gun present a safety concern when the weapon is discharged for the first time.

Therefore, a device is needed which will facilitate bore sighting by enabling a user to look down the bore of a rifle to align the bore with the target and to check for obstructions when this line of sight is not readily accessible.

SUMMARY OF THE INVENTION

The present invention provides for a periscope device comprising a housing shaped to partially fit within the breach of a rifle or other firearm when the housing defines an internal passageway in which two mirrors placed in parallel spaced apart relation to one another and at an angle of 45 degrees to a line of sight. A passageway runs through the housing, and an opening at each of the housing's ends. The device allows a rifleman to look in one end of the periscope device and see as though he or she was looking directly down the barrel of the rifle.

These and other objects, features and advantages of the present invention will become readily apparent to those skilled in the art through a review of the following detailed description in conjunction with the claims and accompanying drawings in which like numerals in several views refer to the same corresponding parts.

DESCRIPTION OF THE PREFERRED EMBODIMENT

The present invention represents broadly applicable improvements for a bore periscope device designed to be placed in a rifle's breach so a rifleman can initially bore sight his or her rifle and check for obstructions within the barrel. The embodiments herein are intended to be taken as representative of those in which the invention may be incorporated and are not intended to be limiting.

Figure 1:
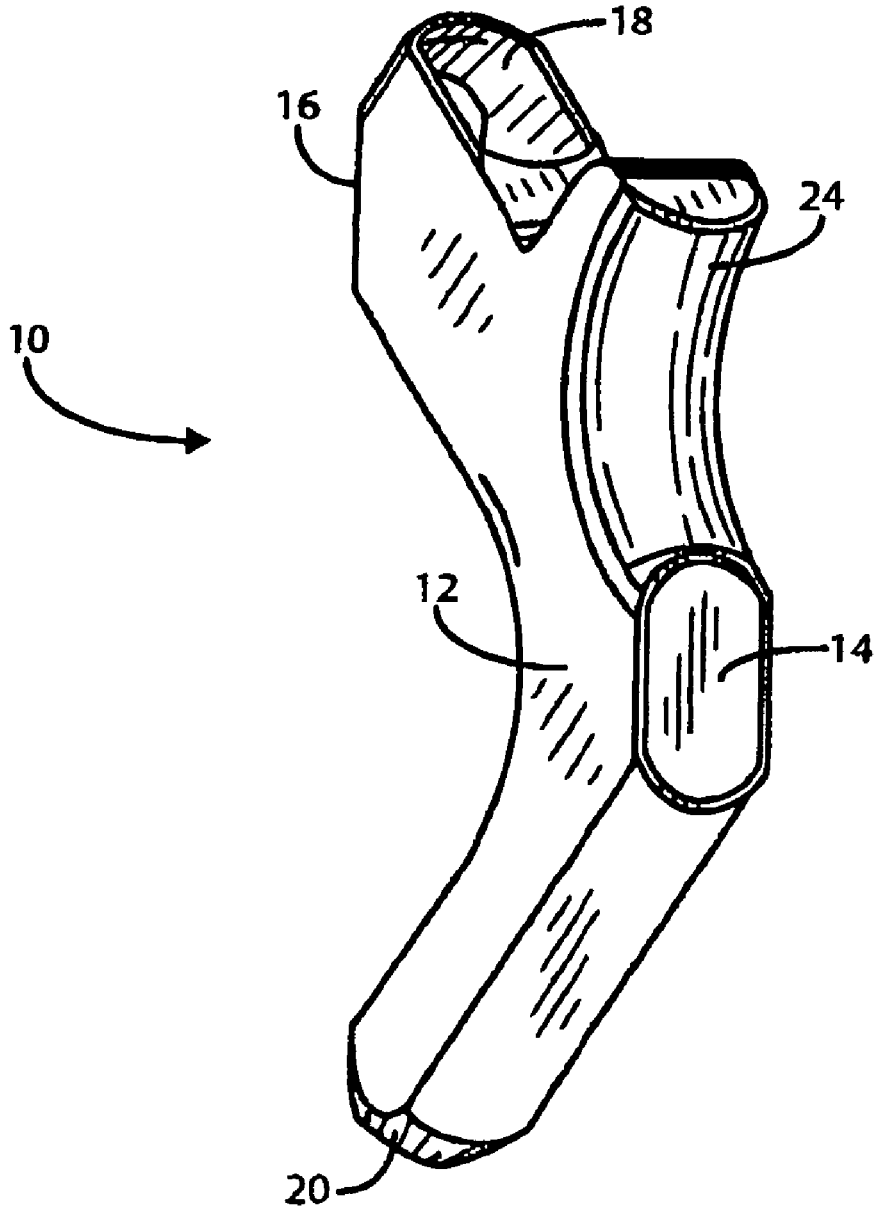
FIG. 1 is a perspective view of the periscope device of the present invention.

Referring first to FIG. 1, there is shown a perspective view of a bore periscope assembly. The assembly itself is indicated generally by numeral 10 and includes a housing 12, mirror mounting surfaces 14 and 16, viewing opening 18, conical barrel opening 20, and an optical passageway 22 (not shown in FIG. 1) running throughout the housing and leading from the viewing opening 18 to a conical barrel opening 20. Additionally, there is a mounting flange 24 projecting from the side of the device on which a magnification scope mount 26 (see FIG. 4) may be installed.

Figure 2:
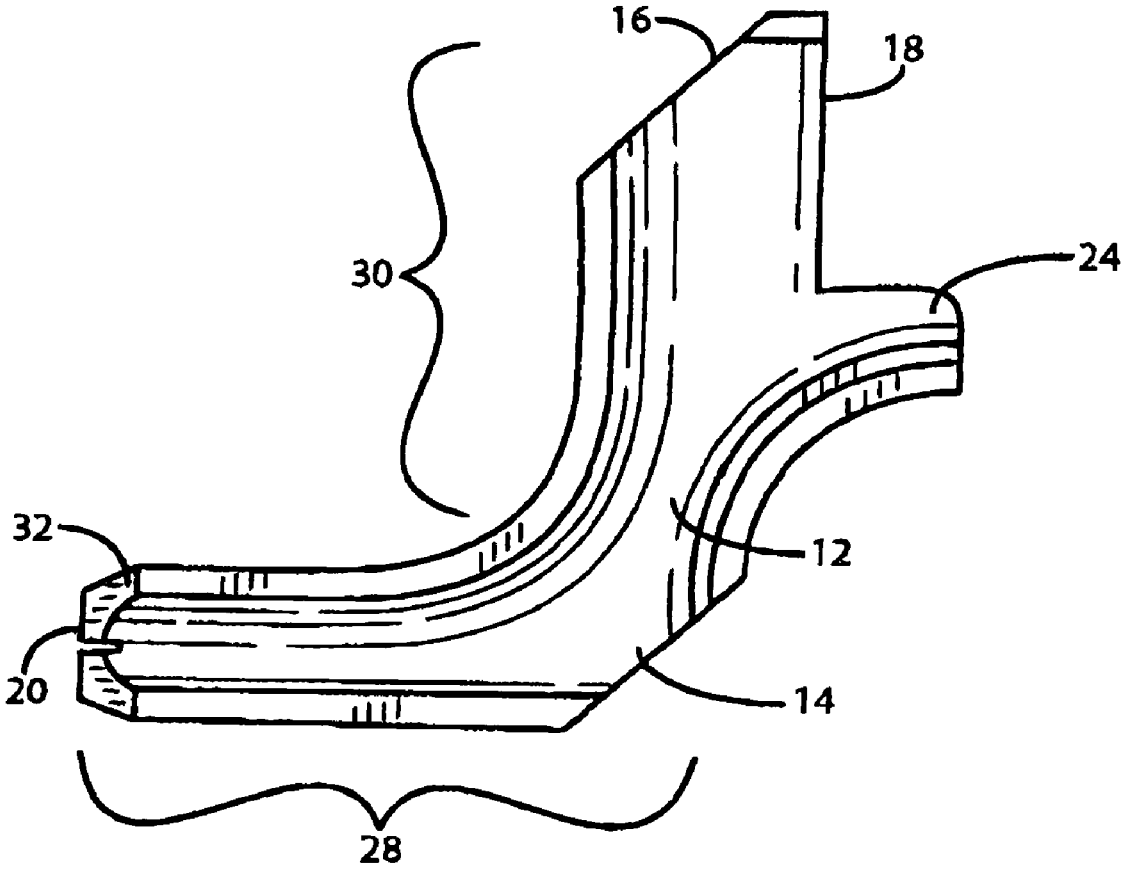
FIG. 2 is a side view of the periscope device of the present invention.

With reference to FIG. 2, a side view of the bore periscope is shown. The housing 12 is made up of a lower horizontal segment 28, a vertical segment 30, and flange 24. The periscope housing 12 generally has a ⅝" radius bore that is flattened on the sides to ½" to fit into a narrow chamber or a larger one. The lower horizontal segment 28 is the part that is placed within the breach of the rifle. The axis of the barrel and of the passageway inside segment 28 is generally aligned. Mirror surfaces 14 and 16 each line the inner walls of the housing at 45 degree angles to the axis of the corresponding passageway length through segments 28 and 30 respectively. Flange 24 extends in a curved fashion from mirror 14 into a small protuberance protruding generally at a right angle to vertical segment 30. Flange 24 may be used to secure an additional magnification scope mount 26 (see FIG. 4).

By examining FIG. 2, the pathway by which images are reflected through the device is easy to understand. An individual peering through opening 18 sees the reflection off mirror 16, which is the reflection of mirror 14, which is the reflection of opening 20. Therefore, looking through opening 18 gives the same viewpoint as if one were looking out opening 20 from within the rifle's barrel.

Figure 3:
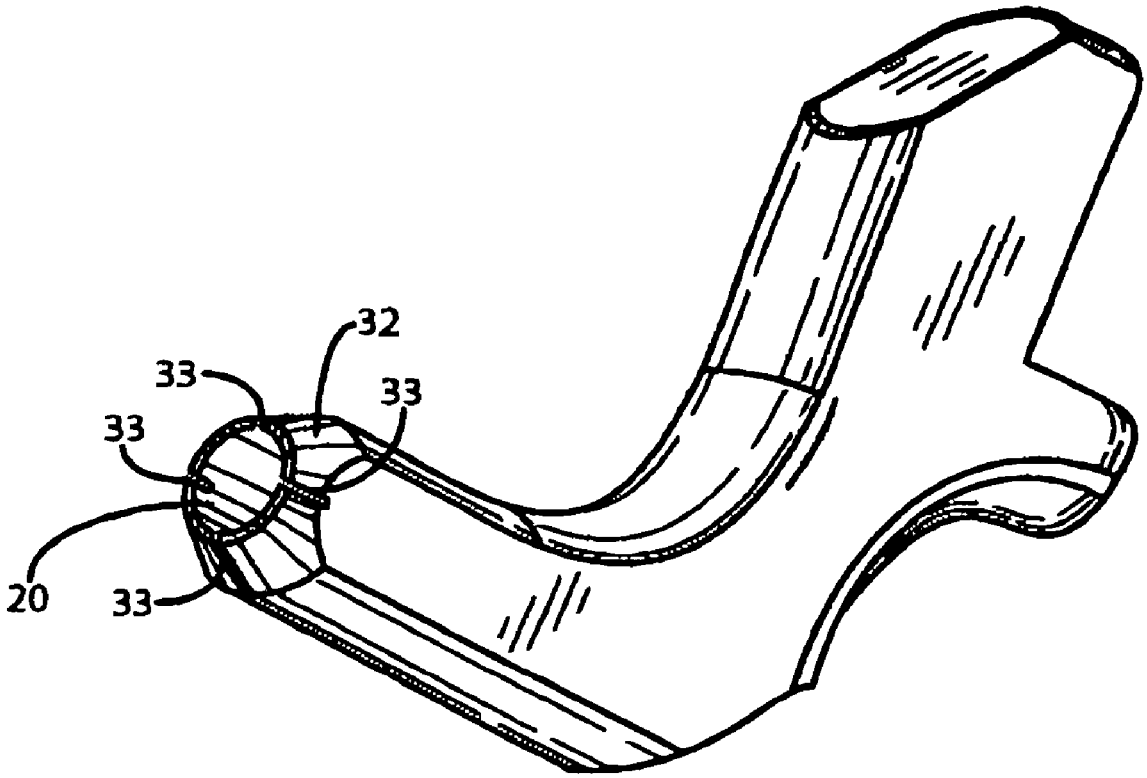
FIG. 3 is a perspective view of the periscope device of the present invention.

Referring now to FIG. 3, another perspective view of the bore periscope assembly 10 is shown. From this perspective the conical barrel opening 20 can be understood more fully. A short conically tapered section 32 extends from the free end of segment 28. Four narrow slots 33 are equally spaced about the perimeter of opening 20. When these slots are viewed as one looks down the bore of the rifle, they appear as peripheral crosshairs. These aid the user in more accurately centering the view of the bore on the target.

Figure 4:
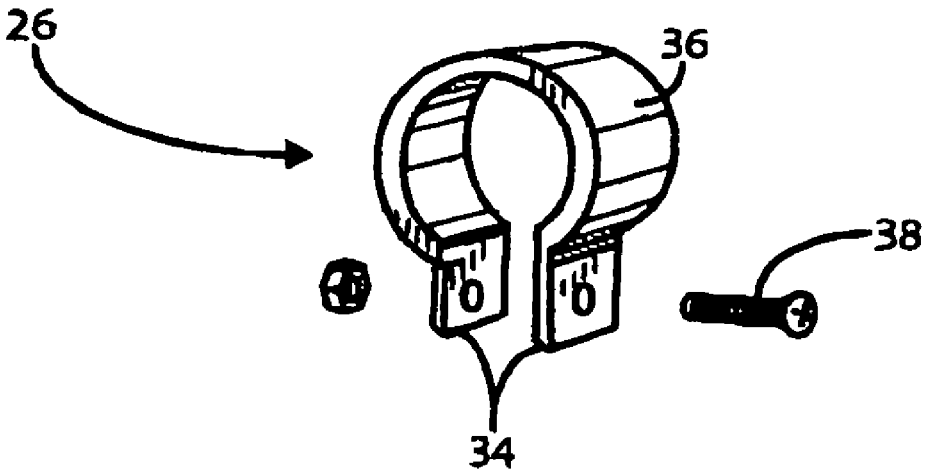
FIG. 4 is a perspective view of the scope mount of the present invention.

FIG. 4 discloses a magnification scope mount 26. This scope mount 26 and its corresponding magnification scope 35 (see FIG. 5) are not required to operate the present invention, but when these pieces are added to the device they enhance and enlarge images seen at opening 18. A scope mount 26 is composed of a clamping device 34, hoop 36, and bolt 38. The scope mount 26 is clamped to the flange 24 of the bore periscope 10 using the bolt to squeeze clamps 34 onto the flange. The hoop 36 of the scope mount is then ready for the magnifying scope 35 to be concentrically inserted. The clamping device and hoop are readily tightened or loosened by turning the bolt 38.

Figure 5:
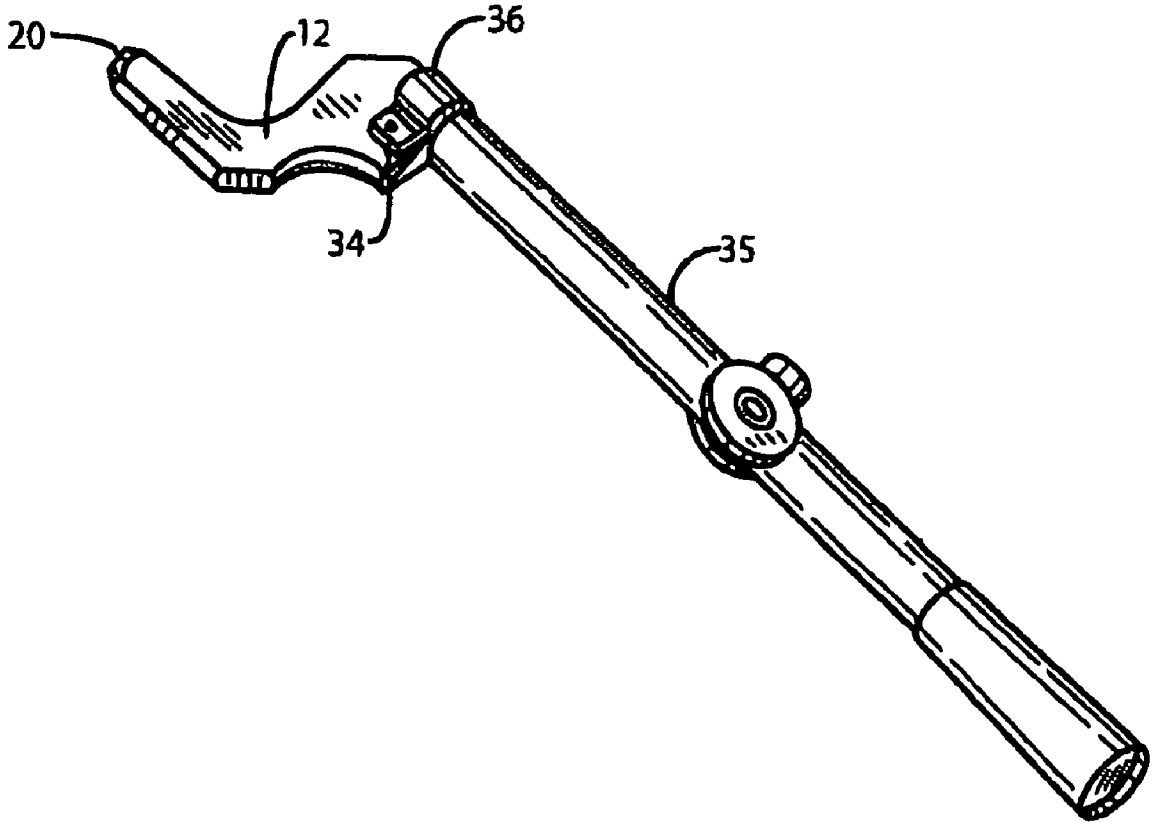
FIG. 5 is a perspective view of the assembled housing, scope mount and magnification scope of the present invention.

Shown in FIG. 5 is a view of the scope mount 26 and the magnification scope 35 as they would be assembled with respect to the housing 12 of the present invention. The barrel of the scope 35 is secured within the hoop 36 of the scope mount 26. A viewer looking through scope 35 may then observe the environment outside opening 20 in a magnified view.

Now that the details of the mechanical construction of the bore periscope of the present invention have been described, consideration will next be given to its mode of operation. The present invention is capable of operating when the user inserts section 24 of the present invention into the breach of the rifle to be sighted, the opening 20 being closest to the barrel. Next, the user looks into opening 18 to see the reflected image of what is seen at opening 20. The user examines this image for obstructions in the barrel and proceeds to align the crosshairs of his view with the center of the target he would like to hit, which may be 50 yards or more away. He or she then synchronizes the gun's sight with the same target used. After taking steps to steady the gun in this position by placing it in a stationary mount, e.g. sandbags or a rifle evaluator, the bore periscope of the present invention is removed from the breach of the rifle. The sights are then "zeroed". More particularly, the gun is loaded and a shot is fired at a target without any movement of the firearm. The scope on the rifle is then adjusted using the existing positioning screws on the scope sight so that its crosshairs align with the location hit by the first shot. In this way, a rifle is sighted in a safe and effective way.

It can be seen, then, that the present invention provides an improved, versatile, efficient periscope device for bore sighting a rifle. The result is that a safer and more efficient rifle sighting process can be performed. Specifically note that while the description of this device has been primarily described as suitable for rifles, this invention is equally well suited for any firearm with a bore that is difficult to look down once the gun is placed in its stationary mount.

This invention has been defined herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself

What is claimed is:

1. A bore periscope for looking down the bore of a firearm comprising, in combination:

(a) a housing adapted to fit partially within the breach of a firearm, the housing containing an optical path extending from a first opening to be concentrically aligned with a bore in a barrel of the firearm to a second opening located outside the breach of the firearm;

(b) a conical inwardly tapered tip extending around the first opening of the housing, the tapered tip having narrow slits around its periphery which appear as crosshairs when viewed from the second opening of the housing; and (c) a plurality of mirrors placed within said optical path within said housing in spaced apart relation such that a user looking in the second opening can view a reflected image appearing as though he was looking out the first opening, down the bore in the barrel of the firearm.

2. The bore periscope of claim 1 wherein the housing contains a flange on which additional components can be attached.

3. The bore periscope of claim 1 wherein the outer side surfaces of the housing are generally flat.

4. The bore periscope of claim 1 wherein the mirrors are oriented at approximately 45 degree angles in relation to the axis of the firearm barrel.

5. A bore periscope for looking down the bore of a firearm barrel comprising, in combination:

(a) a housing member adapted to be partially inserted into the breach of a firearm;

(b) two mirror surfaces disposed in parallel spaced relation within said housing, each at an angle of 45 degrees to a given line of sight; and (c) an interior channel within said housing forming a multi-directional passage from a first opening at one end of the housing to a second opening at the other, there being a conically inwardly tapered tip extending around the first opening of the housing, the conical tip having narrow slits around its periphery which appear as crosshairs when looking in the second opening of the housing.

6. The bore periscope of claim 5 wherein the housing contains a flange on which additional components can be attached.

7. The bore periscope of claim 5 wherein opposed sides of the housing members are generally flat.

* * * * *